United States Patent [19]

Ho

[11] Patent Number: 4,695,373

[45] Date of Patent: Sep. 22, 1987

[54] EXTRACTION OF HYDROCARBON-CONTAINING SOLIDS

[75] Inventor: Phillman N. Ho, Yorba Linda, Calif.

[73] Assignee: Union Oil Company of California, Los Angeles, Calif.

[21] Appl. No.: 824,832

[22] Filed: Jan. 31, 1986

Related U.S. Application Data

[63] Continuation of Ser. No. 694,009, Jan. 23, 1985, abandoned, which is a continuation-in-part of Ser. No. 599,480, Apr. 12, 1984, abandoned.

[51] Int. Cl.[4] ..... C10G 1/00; C10G 1/04

[52] U.S. Cl. ..... 208/428; 208/429; 208/432; 208/433; 208/435

[58] Field of Search ..... 208/11 LE, 11 R, 8 LE, 208/435, 428, 432, 433, 429

[56] References Cited

U.S. PATENT DOCUMENTS

| | | | |
|---|---|---|---|
| 1,327,572 | 1/1920 | Ryan | 208/428 |
| 4,108,760 | 8/1978 | Williams et al. | 208/390 |
| 4,116,022 | 8/1979 | Tsai | 34/116 |
| 4,224,136 | 9/1980 | zu Kocker et al. | 208/408 |
| 4,303,495 | 12/1981 | Behrmann et al. | 208/400 |
| 4,428,821 | 1/1984 | Baset | 208/428 |
| 4,438,816 | 3/1984 | Urban et al. | 208/435 |
| 4,449,586 | 5/1984 | Urban et al. | 208/434 |
| 4,461,696 | 7/1984 | Bock et al. | 208/434 |
| 4,521,293 | 6/1985 | Scinta et al. | 208/430 |
| 4,533,460 | 8/1985 | Ho | 208/407 |
| 4,536,279 | 8/1985 | Audeh | 208/434 |

FOREIGN PATENT DOCUMENTS

| | | |
|---|---|---|
| 292280 | 8/1929 | Canada . |
| 639769 | 4/1962 | Canada . |

OTHER PUBLICATIONS

Defensive Publication No. 700,489, "Contacting Oil Shale or Shale Oil with a Solvent to Produce Material Suitable for Hydrofining," Long et al., published Apr. 15, 1969.

*Primary Examiner*—Asok Pal

*Attorney, Agent, or Firm*—Yale S. Finkle; Gregory F. Wirzbicki; Dean Sandford

[57] ABSTRACT

Hydrocarbon liquids are recovered from oil shale and other solids containing organic material by heating the solids to a temperature below about 900° F., preferably between about 550° F. and about 900° F., in the absence of an added liquid organic solvent and then contacting the heated solids with a liquid organic solvent in such a manner that the solids and solvent do not form a slurry and under conditions such that hydrocarbons are extracted from the heated solids into the organic solvent. The extracted hydrocarbons are then recovered from the solvent by fractionation. Normally, the solids will be heated by contacting them with a hot, nonoxidizing gas, preferably an oxygen-free flue gas generated within the process.

21 Claims, 1 Drawing Figure

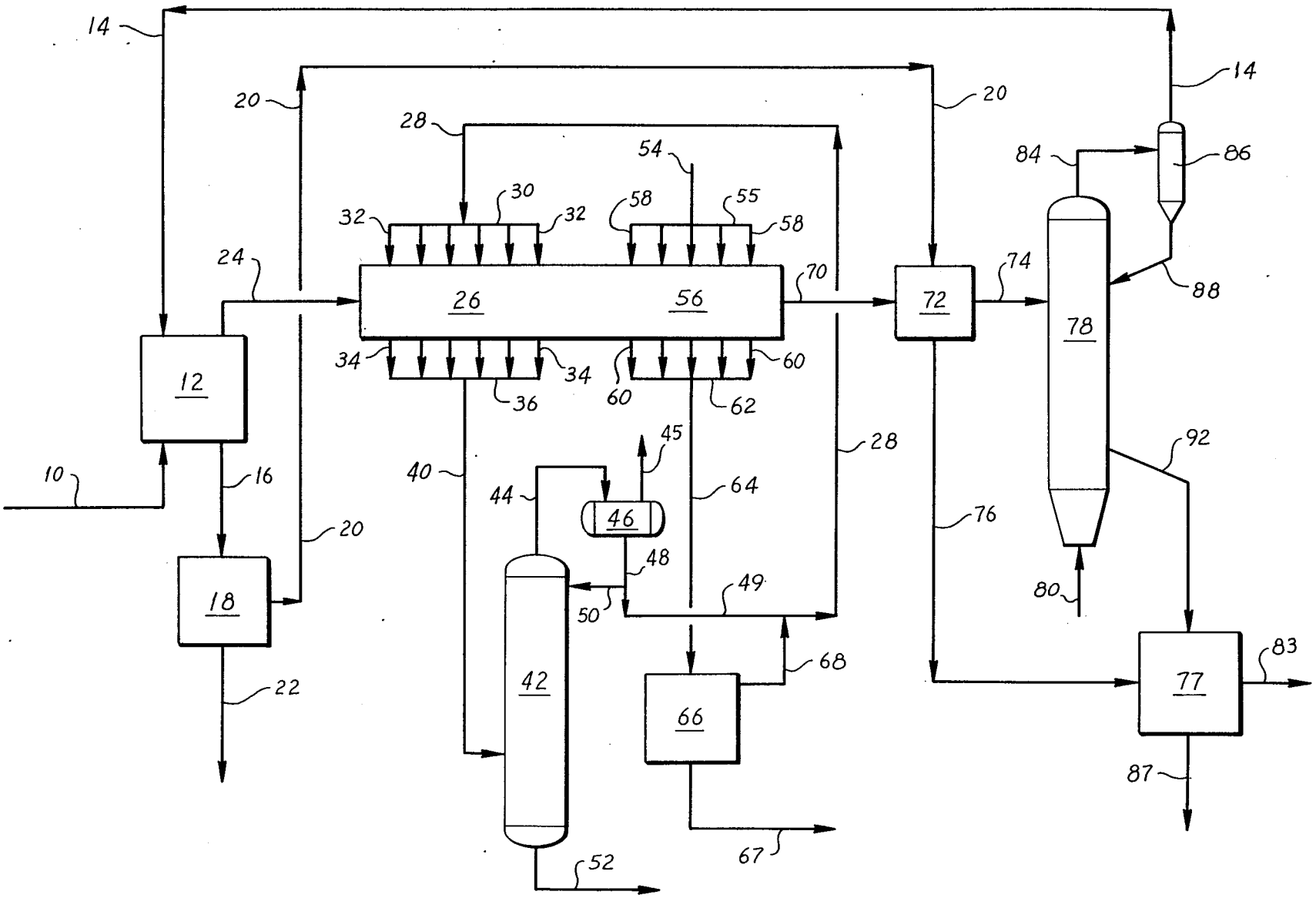
10
12
14
16
18
20
22
24
26
28
30
32
34
36
40
42
44
45
46
48
49
50
52
54
55
56
58
60
62
64
66
67
68
70
72
74
76
77
78
80
83
84
86
87
88
92

EXTRACTION OF HYDROCARBON-CONTAINING SOLIDS

CROSS-REFERENCE TO RELATED APPLICATIONS

This application is a continuation of application Ser. No. 694,009, filed in the United States Patent and Trademark Office on Jan. 23, 1985 and now abandoned, which is a continuation-in-part of application Ser. No. 599,480, filed in the United States Patent and Trademark Office on Apr. 12, 1984 and now abandoned.

BACKGROUND OF THE INVENTION

This invention relates to a process for recovering organic material, primarily liquid hydrocarbons, from solids containing organic material and is particularly concerned with a process for extracting hydrocarbons from oil shale that has been heated to temperatures below those encounted in conventional oil shale retorting processes.

Because of a dwindling supply of petroleum liquids from underground reserviors, attention has recently been focused on the recovery of hydrocarbon liquids and gases from solids such as oil shale, coal, industrial and municipal solid wastes and the like. Work by both governmental agencies and private industry has demonstrated that the organic material in such solids can be converted with varying degrees of difficulty into hydrocarbonaceous fluids such as combustible gases, motor fuels, heating and fuel oils, and various by-products which are of value in chemical and petrochemical industries. In general, the more attractive of the recovery techniques previously proposed involve the heat treatment of such solids in a manner sufficient to pyrolyze or otherwise decompose the organic material into the above-mentioned hydrocarbonaceous products.

Oil shale is considered to be one of the best candidates of all hydrocarbon-containing materials for processing in a retorting or pyrolysis scheme since it is a mixture of a minor amount of solid organic matter called kerogen and a major amount of mineral matter. The organic matter of kerogen is a polymer which is virtually insoluble in organic solvents. Because of this insolubility, it has been difficult in the past to extract the kergon from the oil shale and therefore the application of heat via pyrolysis or retorting has had to be used. The retorting process is carried out at relatively high temperatures, normally between about 900° F. and about 1000° F., in order to cause the solid organic matter to undergo destructive pyrolysis and simultaneous conversion into various hydrocarbonaceous products. In general, only about 75 percent of the organic material in the oil shale is recovered as fluid products. The other 25 percent of the organic material is left as coke or a carbon-rich residue on the spent shale particles. Although this residue can be used as a fuel, it is advantageous to convert more of the organic material into recoverable liquid hydrocarbons. Furthermore, the spent shale particles contain over 95 percent by weight of inert materials and are cumbersome to burn as a fuel. Another disadvantage of retorting is that it does not offer the flexibility to change the liquid yield by either decreasing or increasing the amount of carbon-rich residue remaining on the solids.

An alternative approach to retorting is to heat the oil shale in the presence of a liquid solvent to extract the organic material from the rock matrix as is taught in U.S. Pat. No. 1,327,572. In the disclosed process, ground raw shale is slurried with a heavy oil and heated sufficiently to liquify the hydrocarbon in the rock. Processes such as this must normally be carried out at relatively high pressures and temperatures with large solvent-to-shale ratios in order to obtain liquid yields comparable to those produced in conventional retorting processes. Operation at high pressure and temperature, however, has major disadvantages. The equipment utilized in handling solids under pressure is very complex and the solvents tends to degrade at high temperature. Furthermore, it has been found that when raw shale is mixed with hot solvent or previously heated shale is mixed with solvent at any temperature, the shale has a tendency to disintegrate into fines that are difficult to separate from the solvent and extracted liquids.

Accordingly, it is one of the objects of the present invention to provide a process for increasing the yield of hydrocarbon liquids from the processing of solids containing organic material. It is another object to provide such a process which can be operated at relatively low pressures and temperatures. It is a further object of the invention to provide a process which can be operated to avoid degradation of the extraction solvent and excessive distintegration of the soldis undergoing extraction. It is yet a further object to provide a process in which the liquid yields can be controlled as desired by leaving more or less organic material in the spent solids. These and other advantages will become more apparent in view of the following description of the invention.

SUMMARY OF THE INVENTION

In accordance with the invention, it has now been found that relatively large amounts of organic material can be extracted with a liquid organic solvent from hydrocarbon-containing solids such as oil shale by heating the solids in a nonoxidizing atmosphere to a temperature below about 900° F., preferably between about 550° F. and about 900° F., in the substantial absence of an added liquid organic solvent and then contacting the heated solids with a liquid organic solvent under extraction conditions in order to recover hydrocarbon liquids from the solids. To prevent excessive disintegration of the heated solids, the extraction step is normally carried out without forming a slurry of the heated solids with the organic solvent. Preferably, the solids are heated by contact with a hot, nonoxidizing gas such a hydrogen, carbon dioxide, nitrogen, helium, carbon monoxide, methane, steam, an oxygen-free flue gas and the like. Normally, the heating step will be carried out at a pressure below the critical pressure of any hot gas used to heat the solids. Any conventional organic solvent that will dissolve the organic material in the heated solids can be used in the extraction step provided that it is a liquid at extraction conditions. Preferably, the solvent will be a liquid derived from treatment of the hydrocarbon-containing solids in accordance with the process of the invention. Both the heating step and the extraction step can be carried out at atmospheric pressure. Laboratory studies indicate that carbon conversions substantially greater than those obtainable by pyrolysis of oil shale at typical retorting temperatures can be obtained without excessive particle disintegration by heating the oil shale to a temperature below normal retorting temperatures and subsequently extracting the heated shale with a liquid organic solvent in such a manner that a slurry of the shale and solvent is not formed. Carbon conversions can be further increased by carrying out the extraction step with a solvent containing an added amine.

BRIEF DESCRIPTION OF THE DRAWING

The drawing is a schematic flow diagram of a process for recovering liquids from hydrocarbon-containing solids carried out in accordance with the invention.

DETAILED DESCRIPTION OF THE INVENTION

In the process depicted in the drawing, hydrocarbon-containing solids are introduced into a heater or similar vessel 12 through line 10 from a preparation plant, not shown, in which the solids are crushed and screened or from a storage facility which does not appear in the drawing. Normally, the feed solids will range in size such that the longest dimension of the individual particles is between about 1/64 inch and about 3.0 inches. Since the feed solids have a tendency to disintegrate into fines during processing, it is important that their particle sizes not be overly small. For this reason the feed solids are crushed but not pulverized in the preparation plant. It is most preferable that substantially all the solids fed to the process of the invention be greater in size than about 10 mesh on the U.S. Sieve Series Scale. The feed may be any solids that contain organic material in the form of hydrocarbons. Examples of such solids include oil shale, coal, lignite, solid organic wastes, tar sands, and petroleum coke. Oil shale is the most preferred feed material.

The solids introduced into heater 12 are contacted in the vessel with a hot has introduced into the heater through line 14. This gas will normally be a hot recycle gas produced in the process of the invention as described in detail hereinafter. It will be understood, however, that the hot gas can be any nonoxidizig gas such as hydrogen, carbon monoxide, nitrogen, helium, methane, steam and the like. Preferably, the hot gas is selected from the group consisting of hydrogen, nitrogen, carbon dioxide, an oxygen-free flue gas and a recycle gas containing light hydrocarbons that are non-condensable at the temperature and pressure conditions in heater 12. The most preferred gas in an oxygen-free flue gas or a recycle gas containing light hydrocarbons that are non-condensable at the temperature and pressure conditions in heater 12. In general, it is desired to heat the solids in vessel 12 in the substantial absence of added ammonia, an added liquid organic solvent, added amines and added condensable, hydrocarbon vapors. Thus, the hot gas will normally be substantially free of such constituents. The terms "added ammonia," "added amines" and "added liquid organic solvent" as used herein with respect to the heating step refer respectively to ammonia, amines and liquid organic solvent that are introduced into the heating step of the invention from external sources and do not include ammonia, amines and liquid organic solvent that are produced in the heating step from constituents of the feed solids. The term "added condensable, hydrocarbon vapors" as used herein with respect to the heating step refers to hydrocarbon vapors condensable under the temperature and pressure conditions in the heating step of the process and introduced into the heating step of the invention from external sources. This term does not include hydrocarbon vapors produced in the process from constituents of the feed solids. It will be understood that the solids can be heated in vessel 12 without direct contact with a hot gas. If desired, the heat can be supplied by indirect heat transfer through the walls of vessel 12 or by other well known methods of indirectly transferring heat.

The solids in heater 12 will normally be present in the form of a moving bed or a fluidized bed. If a moving bed is utilized, it can be passed through heater 12 either cocurrently, countercurrently, or crosscurrently with the hot gas. The feed soils are preferably introduced into the bottom of heater 12 and passed upward so they are in countercurrent contact with downwardly flowing hot gas. Examples of vessels which are satisfactory for use as the heater include rotary kilns, circular grates and upright vessels containing fluidized or moving beds.

The flow rate and temperature of the gas are adjusted such that the temperature of the solids in heater 12 is between about 550° F. and about 900° F. In general, the temperature in the heater is maintained below temperatures normally utilized in conventional oil shale retorting processes. Preferably, the temperature of the solids in the heater is between about 650° F. and about 850° F., most preferably between about 700° F. and about 800° F. The pressure in heater 12 may be subatmospheric, atmospheric or superatmospheric but usually ranges from about atmospheric pressure to about 1000 p.s.i.g., preferably from about atmospheric pressure to about 500 p.s.i.g. For ease of operation and mechanical simplicity, the heater is typically operated at a pressure from about atmospheric pressure to about 15 p.s.i.g. Normally, the pressure in the heater is less than the critical pressure of the gas used to heat the solids. The residence time of the solids in the heater typically ranges between about 1.0 minute and about 10 hours, preferably between about 5 minutes and about 120 minutes, and decreases as the temperature in the heater increases. In general, a sufficient amount of hot gas is introduced into the heater so that the superficial velocity is between about 0.1 feet per minute and about 200 feet per minute, preferably between about 5 feet per minute and about 50 feed per minute.

At the temperatures extant in heating vessel 12, a portion of the organic material present in the solids fed to the heater will decompose into light hydrocarbon gases and vaporous products which condense into light oils upon cooling. These gases and vapors are removed from the bottom of heater 12, cooled to condense the light oils and passed through line 16 into gas-liquid separator or similar device 18. Here the gaseous constituents, which normally comprise carbon dioxide, hydrogen sulfide and light hydrocarbons such as methane, ethane, propane and butane, are removed from the light oils and withdrawn from the separator through line 20. The light oils are removed from separator 18 through line 22 and passed downstream for further treatment, for example, by fractionation in a distillation column, not shown in the drawings, to produce an overhead anphtha fraction and a liquid produce boiling in the midbarrel range. The naphtha may be passed to a reformer to make gasoline, and the midbarrel boiling constituents may be subjected to catalytic cracking or hydrocracking, depending upon the end product desired.

The heated solids, which still contain significant amounts of organic material, are removed from heater 12 through line 24 and passed to extraction zone 26 where they are deposited on a belt conveyor, not shown in the drawing, and passed horizontally through the zone in contact with a liquid organic solvent introduced downwardly into the zone through line 28, manifold 30 and distribution lines 32. The solids fed to the extraction zone will be similar in size to the solids fed to heater 12, i.e., they will normally range in size such that the longest dimension of the individual particles is between about 1/64 inch and about 3.0 inches and the individual particles will preferably all be greater in size than about 10 mesh on the U.S. Sieve Series Scale. In general, any organic solvent or mixture of solvents that is a liquid under the extraction conditions and will dissolve the organic material in the solids can be used. Examples of suitable solvents include toluene, tetralin, ethers such as tetrahydrofuran, decalin, pyridine, pyrrolidine, petroleum derived oil fractions, liquids derived from the feed solids and amines, preferably primary, normal alkylamines such as n-hexylamine. When the solids being processed are oil shale, the preferable solvent is a shale derived liquid boiling between about 150° F. and about 1,050° F., preferably between about 400° F. and about 850° F. and most preferably between about 470° F. and about 650° F.

As the hydrocarbon-containing solids move horizontally through extraction zone 26 on the belt conveyor, the solvent is passed downwardly through the solids at a rate between about 0.4 and about 2.0 grams of solvent per gram of solids per hour. The solvent disolves the organic material contained in the solids and the resultant liquid mixture is removed from the bottom of the extraction zone through lines 34, manifold 36 and line 40. The temperature in the extraction zone is normally maintained between about ambient temperature and about 600° F., preferably between about 180° F. and about 475° F. The extraction pressure will typically be atmospheric pressure but can range anywhere between about atmospheric pressure and about 1000 p.s.i.g. It has been found that, when primary, normal alkylamines and other lower boiling liquids are used as the solvent in the extraction zone, a significant amount of the organic material can be extracted at ambient temperature. The temperature in the extraction zone will normally depend upon the type of solvent that is employed to extract the organic material and is usually sufficiently high to prevent the solvent from undergoing reflux. The extraction step is most efficient when the solvent is in the liquid phase and it is therefore desirable that the temperature in the extraction zone be such as to prevent the solvent from partially vaporizing. Usually, the solids are contacted with the solvent in the extraction zone in the substantial absence of an aqueous phase.

It has been found, when the solids exiting heater 12 are mixed with sufficient solvent to form a slurry either before or during the extraction step, that the solids tend to disintegrate into finer particles which are difficult to separate from the solvent and extracted liquids. Indeed, the solids may disintegrate to such an extent that a liquid-solids separation is virtually impossible. To avoid such a problem, the solids exiting the heating step are normally not immersed in the extraction solvent, or slurried or stirred with the extraction solvent. The term "slurry" as used herein refers to a combination of solids and liquids in which all the voids between individual particles are substantially filled with liquid. It is most preferable that the solvent be passed downwardly through the solids in such quantities that the solvent "trickles" through the solids without accumulating therein. Thus, it is highly preferred that there be a discontinuous liquid phase in contact with the solids, i.e., that the solids in the extraction vessel never contact or pass through a liquid barrier as would occur, for example, if the solids were immersed or slurried in the liquid solvent. In other words, in the highly preferred embodiment of the invention, the extraction will be carried out such that a portion of the solids will be in contact with the liquid solvent while the remaining solids will have at most only a film of liquid in contact therewith.

The liquid effluent from extraction zone 26, which comprises a mixture of solvent and extracted organic material, is passed through lines 34, manifold 36 and line 40 into fractionator or similar vessel 42 where the solvent is separated from the extracted organic material and any fine particulates. The solvent, which will generally have a boiling point lower than the majority of the constituents comprising extracted organic material, is removed overhead of the fractionator through line 44 along with gases and lower boiling constituents of the extracted organic material. The fractionator overhead is cooled and passed to distillate drum 46 where the gases are taken off overhead through line 45 and passed to downstream units for further processing. The liquid, which contains solvent and lighter constituents of the extracted organic material, is withdrawn from distillate drum 46 through line 48. A portion of this liquid may be returned as reflux to the upper portion of the fractionator through line 50. The remaining liquid is recycled through lines 49 and 28 to extraction zone 26. A heavy oil fraction composed primarily of hydrocarbons boiling above about 650° F. is withdrawn from the fractionator through line 52 and passed downstream for hydroprocessing into desired products. If the solids fed to the process of the invention are oil shale, this heavy oil will be treated to produce a synthetic crude oil by removing olefins, arsenic, organonitrogen compounds, organsulfur compounds and trace metals. The resultant synthetic oil may then be subjected to catalytic cracking or hydrocracking depending upon the desired products.

Although the extraction zone as described above is one in which the hydrocarbon-containing solids are moved horizontally on a belt while the solvent trickles downwardly through the solids, it will be understood that the process of the invention is not limited to this particular type of continuous extraction. For example, the solids could be subjected to an extraction on a circular grate or in a fixed bed. If a fixed bed is utilized, the process would be operated in a batch mode rather than a continuous mode. As the solvent trickles downward through one batch of solids, another batch of solids is removed from heater 12 into another vessel for subsequent contact with the solvent when the first batch of solids has been depleted of organic material. Other devices and methods for use in carrying out the extraction will be familiar to those skilled in the art.

The solids leaving extraction zone 26 will be depleted in organic material and will contain residual components of the solvent. In order to recover the residual solvent, the hydrocarbon-depleted solids are passed on the conveyor belt into steam stripping zone 56 where they are contacted with steam introduced into the stripping zone through line 54, manifold 55 and lines 58. As the hydrocarbon-depleted solids pass horizontally on the belt through the steam stripping zone, residual solvent constituents are stripped from the solids and carried with the steam from the bottom of the steam stripping zone through lines 60, manifold 62 and line 64. The mixture of steam and vaporized solvent is passed into separator or similar device 66 where the vapors are cooled to condense steam and liquid constituents of the solvent. The condensed solvent will be present in separator 66 as a layer of oil floating on water. The solvent is withdrawn from the top of the separator through line 68, mixed with recycle solvent in line 49 and passed to extraction zone 26 via recycle line 28, manifold 30 and distribution lines 32.

After the hydrocarbon-depleted solids were subjected to steam stripping in zone 56, they are withdrawn from the zone through line 70. These solids will contain moisture and less than about 1 weight percent carbon. The wet solids are passed through line 70 into drying zone 72 where they are contacted with the hot gas containing hydrogen sulfide and light hydrocarbons removed from separator 18 through line 20. The hot gas dries the extracted solids by vaporizing water from the solids. Dried solids are withdrawn from the drying zone through line 74 and a mixture of gas and water vapor is removed through line 76.

The dried solids exiting drying zone 72 will contain about 1 weight percent carbon. These solids are passed continuously from the drying zone through line 74 into fluidized bed combustor or similar device 78 where they are introduced into a fluidized bed of solids extending upward within the combustor above an internal grid or similar distribution device not shown in the drawing. The carbon-containing solids are maintained in the fluidized state within the combustor by means of an oxygen-containing gas introduced into the combustor through bottom inlet line 80. The oxygen in the gas introduced into the bottom of the combustor reacts with organic material in the solids fed to the combustor to form carbon dioxide, carbon monoxide and a substantial amount of heat, a portion of which is absorbed by the rising gas. The amount of oxygen-containing gas introduced into the bottom of the combustor is normally controlled so that all of the oxygen is consumed in the reactions that take place in the combustor. Normally, the combustor will be operated at atmospheric pressure and at a temperature maintained between about 1400° F. and about 1600° F.

The gas leaving the fluidized bed in combustor 78 passes through the upper section of the combustor, which serves as a disengagement zone where particles too heavy to be entrained by the gas leaving the vessel are returned to the bed. If desired, this disengagement zone may include one or more cyclone separators or the like for the removal of relatively large particles from the gas. The gas withdrawn from the upper part of the combustor through line 84 will normally contain a mixture of carbon monoxide, carbon dioxide, nitrogen, entrained fines and sulfur dioxide formed from the sulfur contained in the solids fed to the combustor. This hot flue gas is introduced into cyclone separator or similar device 86 where the fine particulates are removed and returned to the combustor 78 via dipleg 88. The hot flue gas, which will be substantially free of molecular oxygen, from which the fines have been removed is withdrawn overhead from separator 86 through line 14 and recycled to heater 12 where its heat is used to raise the temperature of the feed solids introduced into vessel 12 through line 10.

Combusted particles containing little or no carbon are removed from the fluidized bed in combustor 78 through line 92. If the original feed to the process is an oil shale, these decarbonized solids will contain large amounts of calcium oxide and magnesium oxide produced by the decomposition of calcium carbonate and magnesium carbonate in combustor 78. Because of the presence of these constituents, the combusted solids can be used to remove sulfur compounds from gases. It is, therefore, normally desirable to pass the gas stream containing hydrogen sulfide, light hydrocarbons and water vapor removed from drying zone 72 through line 76 to contactor or similar device 77 where the gas stream is contacted with the combusted solids removed from combustor 78 through line 92. After contact with the combusted solids, this gas stream will be essentially free of hydrogen sulfide. The gas stream is withdrawn from contactor 77 via line 83 and passed downstream for other use. In some cases it may be desirable to recycle a portion of the gas stream removed from contactor 77 to the combustor.

After the decarbonized solids removed from the combustor have been contacted with the gas in line 76, they are removed from contactor 77 through line 87 and can then be used to sweeten the sour water removed from separator 66 through line 67. Upon contact of this water with the decarbonized solids, sulfur compounds will chemically react with, or be adsorbed by, the alkaline constituents in the burned solids. The sweet water removed from this treatment step can then be recycled for use in the process. The solids exiting the sweetening step can then be disposed of as landfill.

In the embodiment of the invention shown in the drawing and described above, the heated solids are subjected to a solvent extraction followed by a steam stripping step. It will be understood that the process of the invention is not limited to the use of one extraction step and a steam stripping step. For example, it may be desirable to use two extraction steps in sequence with or without a followig steam stripping step. If a second extraction step is desired, the solvent used will normally be one that is less viscous and lower boiling than the solvent used for the first extraction. Examples of solvents suitable for use in the second extraction include toluene, benzene, ethanol, pyrrolidine, naphtha and the like. The second extraction step may be carried out at atmospheric pressure and at a temperature below the temperature of the first extraction. If the first extraction is carried out at or near ambient temperature, the second extraction will normally be conducted at about the same temperature. Depending on the solvent used in the second extraction, the steam stripping step may not be required. The effluent from the second extraction step is normally subjected to fractionation to separate the solvent used in the second extraction step from residual constituents of the solvent used in the first extraction step and the additional hydrocarbons removed from the solids in the second extraction step. The second extraction step solvent recovered by fractionation may be recycled to the second extraction step and the residual constituents of the first extraction step solvent and the additional hydrocarbons removed from the solids in the second extraction step may be recycled to the first extraction step if so desired.

The two-stage extraction scheme described above is normally utilized when the first stage solvent is relatively heavy, as is the case when the solvent is derived from oil shale. The second extraction with a lighter solvent is usually necessary to effectively strip the heavier solvent constituents from the solids exiting the first stage extraction. It has now been found, however, that the need for the second stage extraction can be eliminated while at the same time increasing overall carbon conversions by carrying out the first extraction with an organic solvent containing an added amine. Preferably, the added amine is selected from the group consisting of (1) N-methylaniline, (2) pyrrolidine, (3) a primary alkylamine having the formula $R_1NH_2$ where $R_1$ is a straight or branched chain alkyl radical having from 1 to 10 carbon atoms, a substituted or unsubstituted cycloalkyl radical having from 5 to 12 carbon atoms, or a substituted or unsubstituted bicycloakyl radical having from 9 to 18 carbon atoms, and (4) a diamine having the formula $NH_2—R_2—NH_2$ where $R_2$ is a straight or branched chain alkyl radical having from 2 to 12 carbon atoms. The most preferred amines for use in the extraction step along with the organic solvent are the primary alkylamines examples of which include methylamine, ethylamine, iso-butylamine and cyclohexylamine. The most preferred diamine for use as an additive to the solvent in the extraction zone is 1,6 hexanediamine. The above-identified amines have been found to increase carbon conversions when used in conjunction with the liquid organic solvent in the extraction zone. It will be understood that the solvent may itself be one of the amines identified above. Obviously, when this is the case, there would be no reason to introduce another of the above-identified amines into the extraction zone.

The pysical state of the amine will normally determine how it is added to the extraction zone. For example, if the amine is a gas such as ethylamine, it can either be introduced into line 24 and passed into extraction zone 26 with the solids or introduced into line 28 and passed into the extraction zone with the solvent. The effluent from the extraction zone would then be passed through line 40 to a gas-liquid separator where the gaseous amine is separated from the mixture of liquid solvent and extracted organic material and recycled to the extraction zone. Likewise, if the amine is a liquid, it can either be introduced into line 24 and passed into extraction zone 26 with the solids or introduced into line 28 and passed into the extraction zone with the solvent. The liquid amine is then recovered as a side-stream off fractionator 42 and separately recycled to the extraction zone via line 24 or line 28. If the amine is a solid at ambient temperatures, as is 1,6 hexanediamine, it must first be dissolved in the extraction solvent. Some solid or liquid amines may have an affinity for the extraction solvent and will be difficult to recover for reuse. In such cases recovery of the amine can generally be accomplished by mixing the effluent from the extraction zone with an aqueous liquid such as that removed from stripping zone 56 through line 64. The amine will dissolve in the aqeuous phase, which is then separated from the organic phase and treated with a base such as sodium hydroxide. The base causes the amine to rise to the top of the aqueous phase where it can be recovered for recycle to the extraction zone.

When an added amine is used in the extraction zone in addition to the extraction solvent, the extraction temperature will normally be below about 475° F., preferably between about 80° F. and about 450° F. If the added amine is a gas or liquid, a sufficient amount of the amine is introduced into the extraction zone so that the rate ratio by weight of gas or liquid to solids in the zone is between about 0.01 and about 2.0, preferably between about 0.1 and about 0.8. If the added amine is in the solid state, a sufficient amount of the solid is dissolved in the extraction solvent so that the solvent contains between about 5 weight percent and about 40 weight percent of the amine, preferably between about 15 and about 25 weight percent.

The nature and objects of the invention are further illustrated by the following examples, which are provided for illustrative purposes only and do not limit the invention as defined by the claims. The first and second examples demonstrate that the amount of organic material recoverable from oil shale by extracting the shale with an organic solvent after shale has been heated to a temperature below that used for retorting is greater than the amount than can be recovered by retorting the oil shale at conventional retorting temperatures. The third example illustrates that a two-step extraction of the heated shale results in higher recoveries of organic material than a one-step extraction. Example 4 demonstrates that the use of certain added amines in a one-step extraction increases the amount of organic material that can be recovered.

EXAMPLE 1

In this series of tests, 125 grams of oil shale from the Green River formation in Colorado having a particle size between 6 and 12 mesh on the U.S. Sieve Series Scale are placed in an upright tubular reactor. The shale used is either a relatively lean shale containing 23 gallons per ton of oil or a relatively rich shale containing 40 gallons per ton of oil. The reactor is a three foot long stainless steel welded tube having an outside diameter of one inch. The shale is supported in the reactor between two beds of glass beads and a layer of glass wool is located near the bottom of the lower bed of beads. The reactor containing the shale is then immersed in a fluidized bed sand bath and heated at atmospheric pressure to the temperature and for the time period shown in Table 1. After the shale is heated for the desired length of time, the temperature of the sand bath is lowered such that the temperature of the shale decreases to the desired extraction temperature. The extraction solvent is then trickled down at a rate of about 1.1 grams per gram of shale per hour through the shale bed, which is maintained at atmospheric pressure, at the extraction temperature for a period of one hour. Nitrogen is passed concurrently with the solvent through the shale bed at a rate of 1.2 scf/hr. After the extraction is completed, the flow of solvent and nitrogen is terminated, and steam is passed downwardly through the packed bed of the shale to strip any residual solvent from the bed. The shale is then dried by passing nitrogen over the bed. After the shale is dried, it is removed from the reactor and visually inspected. No significant disintegration of the shale particles is observed. The particles appear to have retained their integrity during the heating and extraction steps. After visual inspection, a portion of the dried shale is analyzed for residual carbon content. A sample of the shale originally placed in the reactor is subjected to a Fischer Assay conversion at 932° F. and the spent shale produced is analyzed for residual carbon. The ratio of the carbon left in the extracted shale to the carbon left in the shale subjected to Fischer Assay is calculated for each run. The results of these tests are summarized as runs 1 through 6 in Table 1 below.

TABLE 1

| Run No. | Grade of Shale (Gals/Ton) | Heat Treatment Temp. (°F.) | Heat Treatment Time (Min) | Extraction Solvent | Extraction Temp. (°F.) | Organic Carbon Conversion (% Fischer Assay) |
|---|---|---|---|---|---|---|
| 1 | 40 | 752 | 90 | Shale Oil* | 464 | 108 |
| 2 | 40 | 770 | 40 | Shale Oil* | 464 | 112 |
| 3 | 40 | 788 | 20 | Shale Oil* | 464 | 109 |
| 4 | 23 | 770 | 40 | Shale Oil* | 464 | 109 |
| 5 | 23 | 788 | 20 | Shale Oil* | 500 | 107 |
| 6 | 23 | 788 | 20 | Shale Oil* | 464 | 110 |
| 7 | 40 | 788 | 20 | n-hexylamine | Ambient | 118 |
| 8 | 40 | 788 | 20 | THF** | Ambient | 105 |
| 9 | 40 | 788 | 20 | Pyridine | Ambient | 111 |
| 10 | 40 | 788 | 20 | Pyrrolidine | Ambient | 118 |
| 11 | 40 | 788 | 20 | n-butylamine | Ambient | 118 |
| 12 | 23 | 788 | 20 | 1. Shale Oil* | 356 | 122 |
| | | | | 2. Toluene | 194 | |
| 13 | 23 | 788 | 20 | 1. Shale Oil* | 482 | 125 |
| | | | | 2. Toluene | 194 | |
| 14 | 23 | 788 | 20 | 1. Shale Oil* | 464 | 123 |
| | | | | 2. Toluene | 194 | |

*Hydrotreated shale oil boiling between 475° F. and 650° F.
**Tetrahydrofuran

As can be seen from the data pertaining to runs 1 through 6 in Table 1, the organic carbon conversion obtained when using a hydrotreated shale oil boiling between 475° F. and 650° F. as the solvent ranges between 107 and 112 percent of the Fischer Assay organic carbon conversion. The Fischer Assay conversion represents the carbon conversion normally expected from retorting. The increased conversion over Fischer Assay appears to be independent of the amount of oil in the feed shale. A comparison of runs 5 and 6 indicates that too high of an extraction temperature may have a deleterious effect on the organic carbon conversion.

EXAMPLE 2

This series of tests is conducted in the same manner as discussed in relation to the series of tests carried out in Example 1 except that after the shale is heated for the desired length of time in the tubular reactor, the reactor is removed from the sand bath and the shale is cooled. The cooled shale is then placed in a beaker with a sufficient amount of an extraction solvent to yield a solvent-to-solids weight ratio of about 5.0 and allowed to sit in a slurry form without agitation for one hour. A significant amount of particle disintegration is observed. The solvent with extracted organic material is then separated by filtration from the extracted solids which are placed in an oven for drying. The dried solids are then analyzed for residual carbon content and the organic carbon conversion is calculated as described in Example 1. The results of these tests are summarized as runs 7 through 11 in Table 1.

The data for runs 7 through 11 indicate that conversions greater than Fischer Array can be obtained using extraction solvents other than scale oil even when the extraction is carried out at a ambient temperatures. When pyrrolidine, n-hexylamine and n-butylamine are used as the extraction solvent at ambient temperatures, conversions higher than those obtained by extraction with shale oil at high temperatures are achieved.

EXAMPLE 3

This series of tests is conducted in the same manner as discussed in relation to the series of tests carried out in Example 1 except that a second extraction step is performed after the heated shale is initially contacted with a hydrotreated shale oil and before steam is passed through the packed bed of shale. After the flow of the first solvent through the bed of shale is stopped, the temperature of the sand bath is further decreased such that the temperature of the shale is lowered to 194° F., the temperature used for the second extraction. Toluene, the second extraction solvent, is then trickled down through a bed of shale, which is maintained at atmospheric pressure, for 30 minutes. Nitrogen is passed concurrently with the toluene through the shale bed at a rate of 1.2 scf/hr. After the second extraction is completed, the same procedure as described with respect to the series of tests carried out in Example 1 is followed. A visual inspection of the solids after the second extraction indicates that there is no significant particle disintegration. The results of these tests are summarized as runs 12 through 14 in Table 1.

The data for runs 12 through 14 indicate that a substantial increase in carbon conversion can be obtained by performing a second extraction with a less viscous and lower boiling solvent than used in the first extraction step. A comparison of runs 6 and 14 indicates that a 11.8 percent increase in carbon conversion is obtained when toluene is used in the second extraction step and all other variables are held constant.

EXAMPLE 4

This series of tests is conducted in the same manner as discussed in relation to the series of tests carried out in Example 1 except that the extraction step is carried out in the presence of small quantities of ethylamine or 1,6 hexanediamine. When gaseous ethylamine is used, it is substituted for the nitrogen used in Example 1 and passed concurrently with the extraction solvent downwardly through the shale bed at a rate of 1.2 scf/hr. When 1,6 hexanediamine, a solid at ambient conditions, is used, it is dissolved in the extraction solvent and the mixture is passed cocurrently with nitrogen downwardly through the shale bed. A visual inspection of the solids after extraction indicates that no significant particle disintegration has taken place. The results of these tests are set forth in Table 2 below.

TABLE 2

| Run No. | Grade of Shale (Gals/Ton) | Heat Treatment Temp. (°F.) | Heat Treatment Time (Min) | Extraction Solvent | Extraction Temp. (°F.) | Amine Additive | Organic Carbon Conversion (% Fischer Assay) |
|---|---|---|---|---|---|---|---|
| 15 | 32 | 788 | 20 | Shale Oil* | 464 | — | 110 |
| 16 | 32 | 788 | 20 | Shale Oil* | 464 | Ethylamine | 116 |
| 17 | 32 | 788 | 20 | Shale Oil* | 464 | 20 wt. % HMDA** | 118 |
| 18 | 32 | 788 | 20 | Toluene | 77 | — | 101 |
| 19 | 32 | 788 | 20 | Toluene | 77 | Ethylamine | 117 |
| 20 | 32 | 788 | 20 | Toluene | 194 | 20 wt. % HMDA** | 120 |

*Hydrotreated shale oil boiling between 475° F. and 650° F.
**HMDA stands for hexamethylenediamine which is the common name for 1,6 hexanediamine.
The reported weight percent is based on the weight of the extraction solvent.

As can be seen from the data set forth in Table 2, the carbon conversion obtained can be increased by adding ethylamine and 1,6 hexanediamine during the extraction step. The increase in conversion is greatest when toluene is used as the extraction solvent. It is believed that the added amine increases conversion by decreasing the affinity of the converted kerogen for the mineral matter in the shale, thereby making it easier to extract the converted kerogen. A comparison of runs 16 and 17 with runs 12 through 14 in Table 1 indicates that the use of an amine additive during extraction does not result in as great a carbon conversion as is obtained by utilizing a second extraction with less viscuous and lower boiling solvent than used in the first extraction.

It will be apparent from the foregoing that the process of the invention provides a method for recovering hydrocarbon liquids from oil shale and other solids containing organic material in quantities greater than that normally obtainable by conventional retorting techniques. Furthermore, the process of the invention can be carried out at atmospheric pressure while avoiding degradation of the solvent and excessive disintegration of the solids undergoing extraction. As a result, it is possible to carry out the process at mild conditions such that the overall cost of liquids produced may be substantially reduced.

Although this invention has been primarily described in conjunction with examples and by reference to several embodiments, including a preferred embodiment, it is evident that many alternatives, modifications, and variations will be apparent to those skilled in the art in light of the foregoing description. Accordingly, it is intended to embrace within the invention all such alternatives, modifications and variations that fall within the spirit and scope of the appended claims.

I claim:

1. A process for recovering hydrocarbon liquids from oil shale solids which comprises:

(a) contacting said oil shale solids with a hot, nonoxidizing gas in the substantial absence of an added liquid organic solvent at a temperature between about 550° F. and about 900° F., wherein said solids are contacted with said hot gas at a pressure below the critical pressure of said gas and in the substantial absence of added ammonia and added amines;

(b) contacting the heated oil shale solids from step (a) with a liquid organic solvent in an extraction zone by passing said solvent downwardly through said solids in the substantial absence of an aqueous phase at a temperature between about ambient temperature and about 600° F. in the presence of an added amine under conditions such that hydrocarbons are extracted from said solids, said added amine being selected from the group consisting of (1) a primary alkylamine having the formula $R_1NH_2$ where $R_1$ is a straight or branched chain alkyl radical having from 1 to 10 carbon atoms, a substituted or unsubstituted cycloalkyl radical having from 5 to 12 carbon atoms, or a substituted or unsubstituted bicycloalkyl radical having from 9 to 18 carbon atoms, (2) a diamine having the formula $NH_2—R_2—NH_2$ where $R_2$ is a straight or branched chain alkyl radical having from 2 to 12 carbon atoms, (3) pyrrolidine and (4) N-methylaniline; and (c) recovering said extracted hydrocarbons from said organic solvent as said hydrocarbon liquids.

2. A process as defined by claim 1 wherein said heated oil shale solids form a fixed bed within said extraction zone.

3. A process as defined by claim 1 wherein said heated oil shale solids are passed horizontally through said extraction zone as said liquid organic solvent is passed downwardly through said solids.

4. A process as defined by claim 1 wherein said hot nonoxidizing gas comprises a gas selected from the group consisting of hydrogen, carbon dioxide, nitrogen, helium, carbon monoxide, methane, steam, an oxygen-free flue gas and a recycle gas generated within said process.

5. A process as defined by claim 1 wherein step (a) is carried out at about atmospheric pressure.

6. A process as defined by claim 1 wherein said liquid organic solvent used in step (b) is selected from the group consisting of toluene, tetralin, decalin, ethers, amines, petroleum derived oil fractions and liquids derived from said oil shale solids.

7. A process as defined by claim 6 wherein said liquid organic solvent comprises liquids derived from oil shale.

8. A process as defined by claim 7 wherein said liquids derived from said oil shale boil between about 400° F. and about 850° F.

9. A process as defined by claim 1 wherein said oil shale solids are contacted with said hot, nonoxidizing gas in the substantial absence of added condensable, hydrocarbon vapors.

10. A process as defined by claim 1 wherein said oil shale solids are contacted with said hot, nonoxidizing gas at a temperature between about 650° F. and about 850° F.

11. A process as definded by claim 1 wherein said liquid organic solvent is passed downwardly through said solids in such quantities that said solids and said solvent do not form a slurry for the duration of the extraction.

12. A process as defined by claim 1 wherein said heated oil shale solids are contacted with said liquid organic solvent in the presence of said added amine at a temperature between about 180° F. and about 475° F.

13. A process as defined by claim 1 wherein said solvent comprises shale oil.

14. A process as defined by claim 1 wherein said added amine comprises methylamine or ethylamine.

15. A process as defined by claim 1 wherein said added amine comprises 1,6 hexanediamine.

16. A process as defined by claim 1 wherein said added amine comprises N-methylaniline.

17. A process as defined by claim 1 wherein said heated oil shale solids are contacted with said liquid organic solvent at a temperature between about 180° F. and about 475° F. and said added amine is selected from the group consisting of methylamine, ethylamine, N-methylaniline, pyrrolidine, and 1,6 hexanediamine.

18. A process as defined by claim 1 wherein said liquid organic solvent is passed downwardly through said solids in such quantities that said solvent passes through said solids without accumulating therein for the duration of the extraction.

19. A process as defined by claim 1 wherein said added amine comprises pyrrolidine.

20. A process as defined by claim 1 wherein said liquid organic solvent is passed downwardly through said solids in such quantities that said solids are not immersed in said solvent for the duration of the extraction.

21. A process as defined by claim 1 wherein said added amine comprises a diamine having the formula $NH_2—R_2—NH_2$ where $R_2$ is a straight or branched chain alkyl radical having from 2 to 12 carbon atoms.

* * * * *